US011408144B2

(12) United States Patent
Zell et al.

(10) Patent No.: US 11,408,144 B2
(45) Date of Patent: Aug. 9, 2022

(54) VARIABLE FLOAT AND VARIABLE BLADE IMPACT

(71) Applicant: Deere & Company, Moline, IL (US)

(72) Inventors: Adam Zell, Dubuque, IA (US); Anthony K. Kraft, Epworth, IA (US)

(73) Assignee: DEERE & COMPANY, Moline, IL (US)

( * ) Notice: Subject to any disclaimer, the term of this patent is extended or adjusted under 35 U.S.C. 154(b) by 403 days.

(21) Appl. No.: 16/555,864

(22) Filed: Aug. 29, 2019

(65) Prior Publication Data

US 2021/0062463 A1 Mar. 4, 2021

(51) Int. Cl.

| | |
|---|---|
| ***E02F 3/84*** | (2006.01) |
| ***E02F 3/76*** | (2006.01) |
| ***E02F 9/20*** | (2006.01) |
| ***E02F 9/22*** | (2006.01) |
| ***F15B 21/00*** | (2006.01) |
| ***F15B 11/08*** | (2006.01) |

(52) U.S. Cl.

CPC ..... *E02F 3/844* (2013.01); *E02F 3/764* (2013.01); *E02F 3/7636* (2013.01); *E02F 3/7645* (2013.01); *E02F 9/2004* (2013.01); *E02F 9/2203* (2013.01); *E02F 9/2228* (2013.01); *F15B 11/08* (2013.01); *F15B 21/001* (2013.01)

(58) Field of Classification Search

CPC ..... E02F 3/764; E02F 3/844; E02F 3/7645; E02F 9/2228; F15B 2211/50518; F15B 2211/50554

See application file for complete search history.

(56) References Cited

U.S. PATENT DOCUMENTS

| | | | |
|---|---|---|---|
| 4,024,796 | A | 5/1977 | Theobald |
| 4,793,183 | A | 12/1988 | Helmus et al. |
| 5,775,075 | A | 7/1998 | Dannar |
| 6,134,814 | A | 10/2000 | Christy et al. |
| 6,988,363 | B2 | 1/2006 | Bitter |
| 7,478,489 | B2 | 1/2009 | Anderson et al. |

(Continued)

FOREIGN PATENT DOCUMENTS

| | | | |
|---|---|---|---|
| JP | 2018131733 | A | 8/2018 |
| WO | WO2010054153 | A2 | 5/2010 |

OTHER PUBLICATIONS

German Search Report issued in counterpart application No. 102020209306.7 dated May 7, 2021 (10 pages).

*Primary Examiner* — Abiy Teka
(74) *Attorney, Agent, or Firm* — Michael Best & Friedrich LLP

(57) ABSTRACT

A method and control system operable to control movement of a work implement of a work vehicle. The control system includes a reservoir that retains fluid, a pump in fluid communication with the reservoir, and an actuator in fluid communication with the pump. The actuator has a first side and a second side. A control valve is fluidly positioned between the pump and the actuator, a first proportional relief valve is fluidly positioned between the pump and the first side of the actuator, and a second proportional relief valve is fluidly positioned between the pump and the second side of the actuator. The first proportional relief valve is configured to permit flow of fluid from the first side of the actuator to the reservoir when a pressure at the first side of the actuator exceeds a pressure set point.

22 Claims, 7 Drawing Sheets

(56) References Cited

U.S. PATENT DOCUMENTS

| | | | | |
|---|---|---|---|---|
| 8,495,870 | B2 | 7/2013 | Sumiyoshi et al. | |
| 8,695,333 | B2 | 4/2014 | Vigholm et al. | |
| 8,793,907 | B2 | 8/2014 | Walimaa et al. | |
| 9,255,380 | B2 | 2/2016 | Ault et al. | |
| 9,315,958 | B2 | 4/2016 | Walimaa et al. | |
| 2006/0065867 | A1* | 3/2006 | Vonderwell | F15B 13/0435 251/30.01 |
| 2007/0022871 | A1* | 2/2007 | Smith | F15B 13/0433 91/461 |
| 2010/0107623 | A1* | 5/2010 | Kerckhove | F15B 11/05 60/327 |
| 2013/0055886 | A1 | 3/2013 | Park et al. | |
| 2019/0316324 | A1* | 10/2019 | Zell | E02F 9/2203 |

* cited by examiner

VARIABLE FLOAT AND VARIABLE BLADE IMPACT

BACKGROUND

The present disclosure relates to a float and blade impact systems and valve configurations for such systems.

SUMMARY

In one embodiment, the disclosure provides a work vehicle including a frame, a prime mover connected to the frame, an operator cab connected to the frame, a work implement that moves with respect to the frame, and a control circuit that controls movement of the work implement. The control circuit includes a pump, and an actuator in fluid communication with the pump. The actuator includes a first side and a second side. A control valve is fluidly positioned between the pump and the actuator, a controller is in electrical communication with the control valve, and a reservoir is in fluid communication with the actuator. A first proportional pressure relief valve is fluidly positioned between the reservoir and the first side of the actuator. The first proportional pressure relief valve permits flow of fluid from the first side of actuator to the reservoir in response to a pressure at the first side of the actuator being greater than a predetermined pressure value. A second proportional pressure relief valve is fluidly positioned between the reservoir and the second side of the actuator.

In one embodiment, the disclosure provides a control system operable to control movement of a work implement of a work vehicle. The control system includes a reservoir that retains fluid, a pump in fluid communication with the reservoir, and an actuator in fluid communication with the pump. The actuator has a first side and a second side. A control valve is fluidly positioned between the pump and the actuator, a first proportional relief valve is fluidly positioned between the pump and the first side of the actuator, and a second proportional relief valve is fluidly positioned between the pump and the second side of the actuator. The first proportional relief valve is configured to permit flow of fluid from the first side of the actuator to the reservoir when a pressure at the first side of the actuator exceeds a pressure set point.

In another embodiment the disclosure provides a method of moving a work implement of a work vehicle in response to an impact force. The method includes setting a first set point pressure at which a first proportional relief valve opens via an operator positioned in the work vehicle, setting a second set point pressure at which a second proportional relief valve opens via the operator positioned in the work vehicle, monitoring an actuator to detect movement thereof from a first position, permitting fluid flow between a first side of the actuator, a reservoir and a pump while the first proportional relief valve is open, and permitting fluid flow between a second side of the actuator, the reservoir and the pump while the second proportional relief valve is open. Upon movement of the actuator from the first position, the method includes determining if an operator commanded the actuator to move. If an operator commanded the actuator to move, the method includes detecting a second position of the actuator, and if an operator did not command the actuator to move, the method includes permitting fluid flow to the first side of the actuator from the pump to thereby move the actuator back to the first position.

In another embodiment the disclosure provides a method of moving a work implement of a work vehicle. The method includes setting a downward force on the work implement, determining a set position of the work implement, permitting fluid flow between a first side of an actuator, a reservoir and a pump while a first proportional relief valve is open, and permitting fluid flow between a second side of the actuator, the reservoir and the pump while a second proportional relief valve is open. Upon movement of the work implement from the set position, the method includes determining if the work implement moved upward or downward from the set position. If the work implement moved upward from the set position, the controller sends a first signal to the first proportional relief valve and to the second proportional relief valve to increase the downward force on the work implement to thereby inhibit further upward movement of the work implement. If the work implement moved downward from the set position, the controller sends a second signal to the first proportional relief valve and to the second proportional relief valve to decrease the downward force on the work implement to inhibit further downward movement of the work implement.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
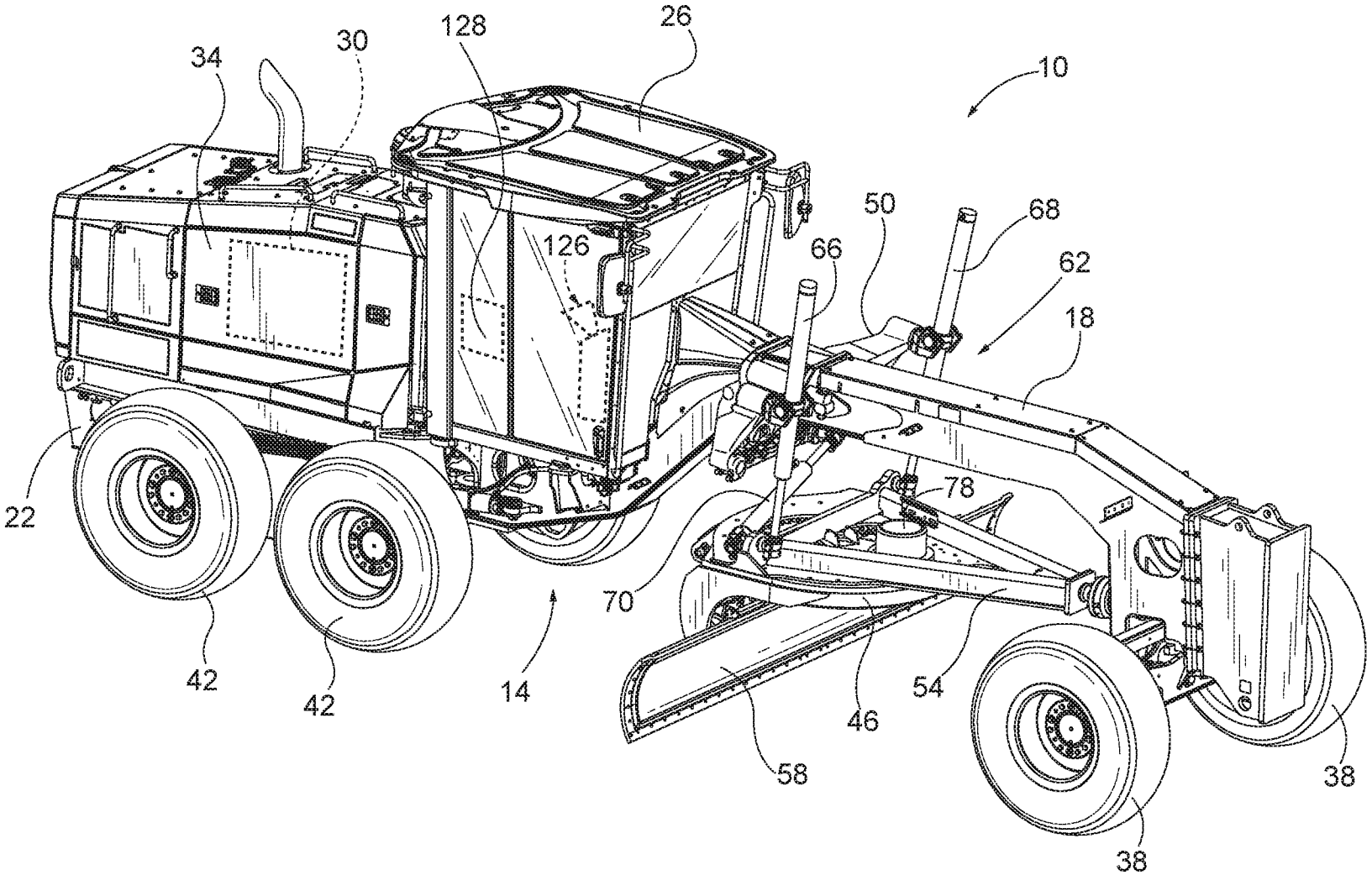
FIG. 1 is a perspective view of a work vehicle in which the disclosed hydraulic articulation system may be implemented.

FIG. 1 illustrates a work vehicle, which is a motor grader (or simply "grader") 10 in the illustrated embodiment. The grader 10 includes a chassis 14 with a front frame 18 and a rear frame 22. The front frame 18 supports an operator cab 26 that may include an operator seat, controls for operating the grader 10, and the like. A prime mover 30 (e.g., a diesel engine) is supported on the rear frame 22 and is enclosed within a compartment 34. The chassis 14 is supported by front wheels 38 at the front of the grader 10 and by tandem rear wheels 42 at the rear of the grader 10.

The grader 10 includes a circle 46 disposed in front of the operator cab 26 and suspended below the front frame 18 by a lifter bracket 50 and a drawbar 54. A work implement, which is a blade 58 or moldboard in the illustrated embodiment, extends laterally across the circle 46. The grader 10 includes a blade positioning assembly 62 that allows the position and orientation of the blade 58 to be adjusted. In the illustrated embodiment, a left lift actuator 66 and a right lift actuator 68 extend between the lifter bracket 50 and the circle 46 to tilt, raise, and lower the circle 46 and the blade 58. A shift actuator 70 is provided to shift the blade 58 laterally relative to the front frame 18, and a pitch actuator 74 (FIG. 2) is provided to vary a pitch angle of the blade 58. The blade positioning assembly 62 also includes a rotary actuator 78 to rotate the blade 58 about a vertical axis. In the illustrated embodiment, the various actuators 66, 68, 70, 74, 78 of the blade positioning assembly 62 are hydraulic actuators (e.g., single or double acting cylinders, hydraulic motors, etc.); however, the blade positioning assembly 62 may alternatively include one or more electric motors, pneumatic actuators, or the like in place of any of the hydraulic actuators 66, 68, 70, 74, 78.

Figure 2:
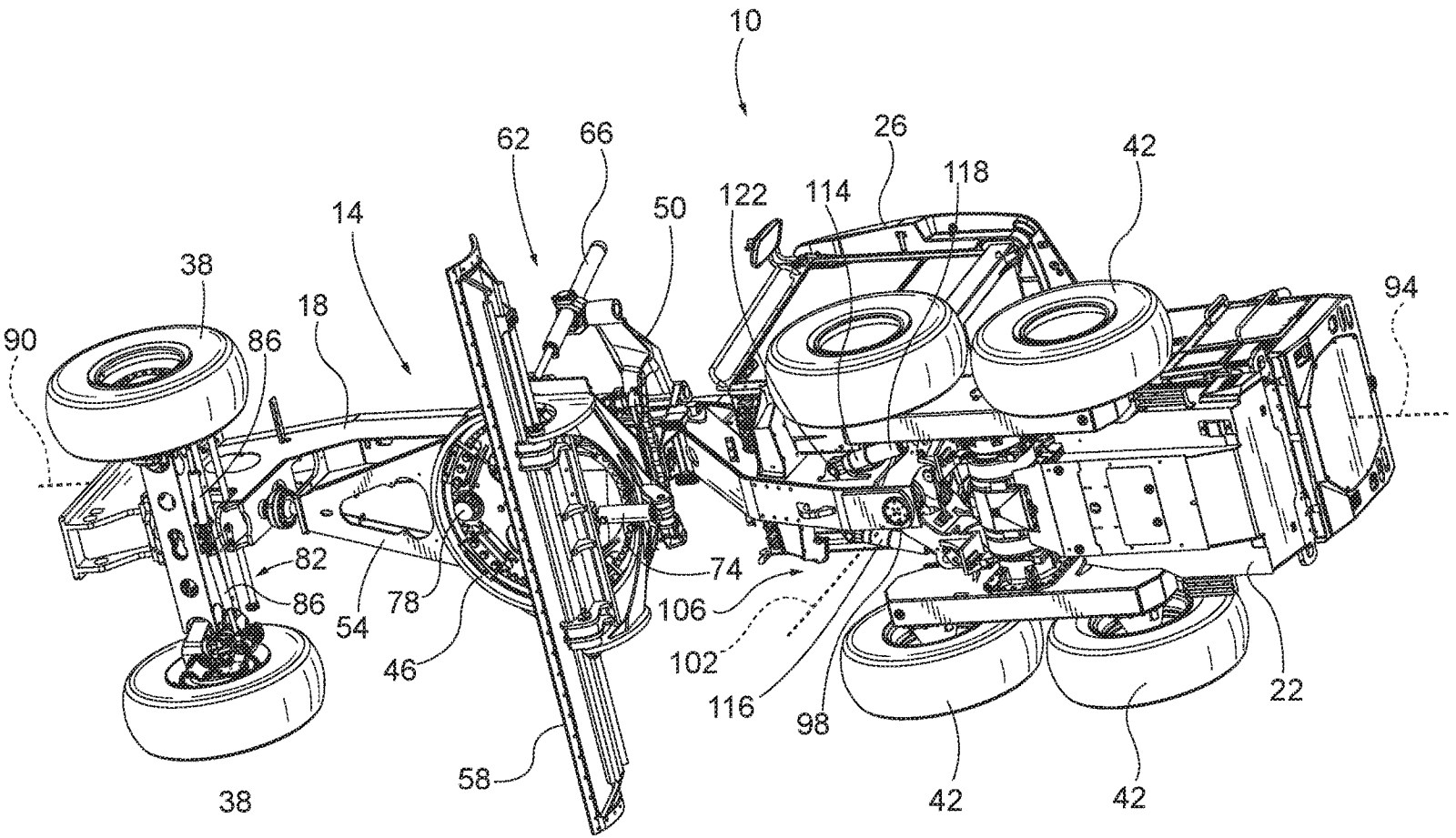
FIG. 2 is another perspective view of the work vehicle of FIG. 1.

The prime mover 30 is coupled to the rear wheels 42 via a suitable transmission (not shown) to drive the rear wheels 42 (FIG. 1). Alternatively or additionally, the prime mover 30 may be coupled to the front wheels 38 to drive the front wheels 38. The front frame 18 supports a steering assembly 82 for steering the front wheels 38 (FIG. 2). The steering assembly 82 includes steering actuators 86, which are hydraulic actuators in the illustrated embodiment. In other embodiments, other types of actuators can be used. In addition, in some embodiments, additional steering actuators may be provided such that both the front wheels 38 and the rear wheels 42 may be steerable.

The front frame 18 of the grader 10 defines a first or front longitudinal axis 90, and the rear frame 22 of the grader 10 defines a second or rear longitudinal axis 94. An articulation joint 98 pivotally couples the front frame 18 and the rear frame 22 and defines a vertical pivot or articulation axis 102 (FIG. 2). The front frame 18 is pivotable relative to the rear frame 22 about the articulation axis 102 to vary an orientation of the front longitudinal axis 90 relative to the rear longitudinal axis 94. The illustrated articulation joint 98 is part of an active articulation assembly 106 that includes first and second articulation actuators 114, 116 extending between the front frame 18 and the rear frame 22 on opposite lateral sides of the articulation axis 102. Each of the illustrated articulation actuators 114, 116 is a double-acting hydraulic cylinder having a head 118 pivotally coupled to the rear frame 22 and a rod 122 pivotally coupled to the front frame 18. In other embodiments, the number and/or arrangement of articulation actuators 114, 116 may vary.

As shown in FIG. 1, a user interface 126 is positioned in the in the operator cab 26 to permit the user to operate the grader 10. In some embodiments, a user could operate the grader 10 from a location outside of the cab (i.e., by remote control). The illustrated grader 10 includes a controller 128 that is configured to control operation of various components of the grader 10 in response to input from the user interface 126 and/or one or more controls remote from the grader 10.

Figure 3:
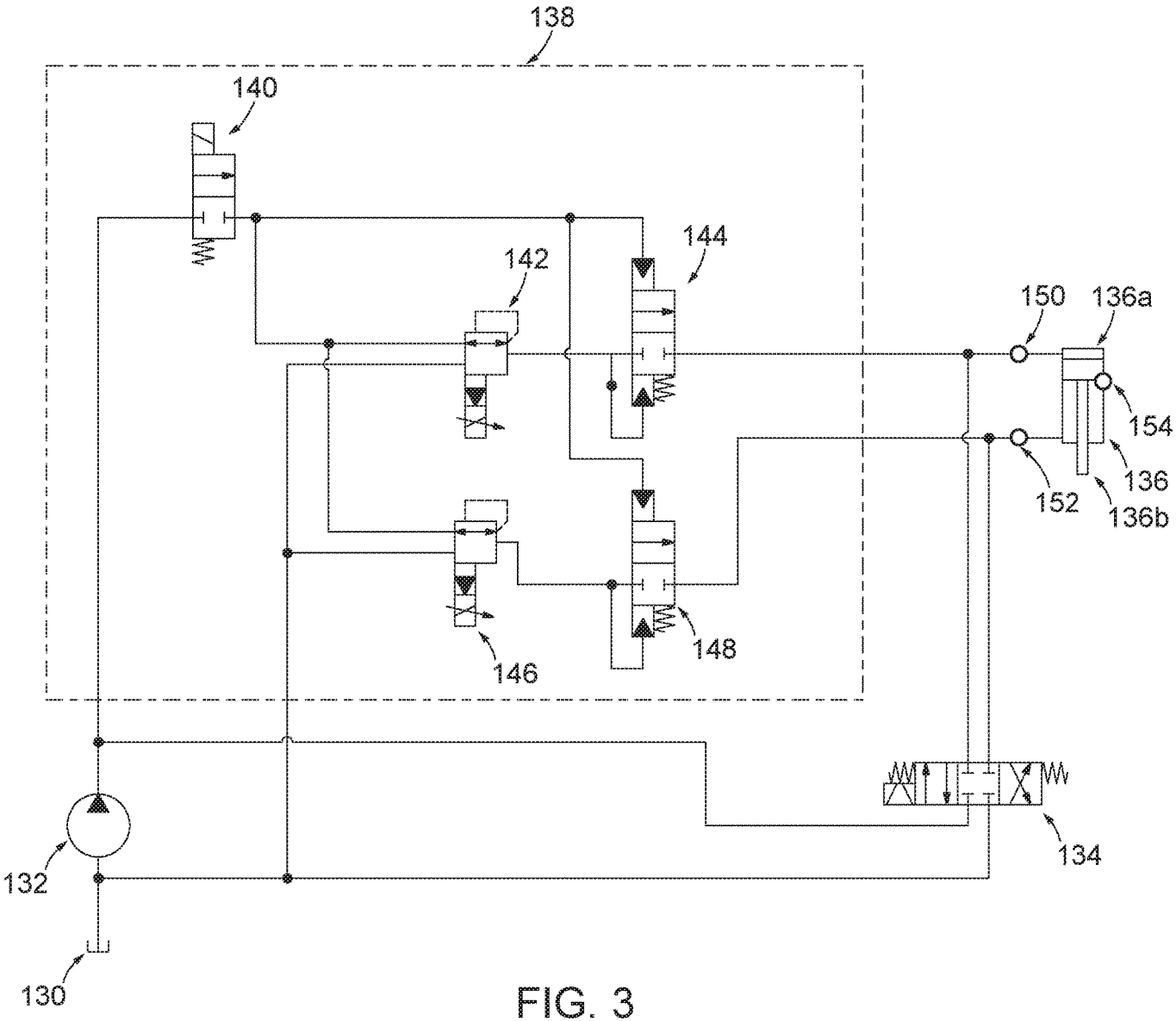
FIG. 3 is a schematic diagram of a control circuit for an hydraulic float and impact system according to some embodiments of the disclosure.

FIG. 3 illustrates a schematic fluid arrangement according to some embodiments. The fluid arrangement includes a reservoir 130, a pump 132, a control valve 134, an actuator 136, and a variable float impact valve 138. Fluid is drawn from the reservoir 130 by the pump 132 and directed through the control valve 134 to the actuator 136 and fluid is moved from the actuator 136 to the reservoir to thereby move the actuator 136 to a desired position. The actuator 136 can correspond to any of the actuators included in FIGS. 1 and 2. The actuator 136 includes a first side 136*a* and a second side 136*b*. In the illustrated embodiments, the first side 136*a* is the head side and the second side 136*b* is the rod side. In some embodiments, the first side 136*a* is the rod side while the second side 136*b* is the head side.

The variable flow impact valve 138 includes a pressure supply valve 140, a first proportional pressure reducing/relieving valve (PPRV) 142, a first lockout valve 144, a second proportional pressure reducing/relieving valve (PPRV) 146 and a second lockout valve 148. When the pressure supply valve 140 is open, fluid flow from the pump 130 to the actuator 136 and from the actuator 136 to the reservoir 130 through the variable impact valve 138 is permitted. When the pressure supply valve 140 is closed, fluid flow through the variable impact valve 138 is inhibited.

The first PPRV 142 permits fluid flow between the first side 136*a* of the actuator 136 and the reservoir 130 and the pump 132 when a pressure at the first PPRV 142 is greater than a first set pressure. In some embodiments, a first pressure sensor 150 is configured to sense a first pressure at the first side 136*a* of the actuator 136. In these embodiments, the first PPRV 142 is configured to open in response to the first pressure sensed by the first pressure sensor 150 exceeding the first set pressure. In other embodiments, the first PPRV 142 is configured to open in response to a pressure at the first PPRV 142 exceeding the first set pressure.

The first lockout valve 144 is fluidly positioned between the first PPRV 142 and the first end 136*a* of the actuator 136. While the first lockout valve 144 is open, fluid communication between the first PPRV 142 and the first end 136*a* of the actuator 136 is permitted. While the first lockout valve 144 is closed, fluid communication between the first PPRV 142 and the first end 136*a* of the actuator 136 is inhibited.

The second PPRV 146 permits fluid flow between the second side 136*b* of the actuator 136 and the reservoir 130 and the pump 132 when a pressure at the second PPRV 146 is greater than a second set pressure. In some embodiments, a second pressure sensor 152 is configured to sense a second pressure at the second side 136*b* of the actuator 136. In these embodiments, the second PPRV 146 is configured to open in response to the second pressure sensed by the second pressure sensor 152 exceeding the second set pressure. In other embodiments, the second PPRV 146 is configured to open in response to a pressure at the second PPRV 146 exceeding the second set pressure.

The second lockout valve 148 is fluidly positioned between the second PPRV 146 and the second end 136*b* of the actuator 136. While the second lockout valve 148 is open, fluid communication between the second PPRV 146 and the second end 136*b* of the actuator 136 is permitted. While the second lockout valve 148 is closed, fluid communication between the second PPRV 146 and the second end 136*b* of the actuator 136 is inhibited.

The first pressure sensor 150 and the second pressure sensor 152 are in communication with the controller 128 via one or more wired and/or wireless connections. A position sensor 154 can be connected to the actuator 136 to confirm the position of the piston within the actuator 136. The position sensor 154 is in communication with the controller 128 via one or more wired and/or wireless connections.

The controller 128 is in communication with the user interface 126 such that in response to input via the user interface 126 as well as the sensors 150, 152 and 154, the controller 128 is configured to send one or more signals to the control valve 134 to move the control valve 134. The controller 128 is also configured to send one or more signals to the first PPRV 142 to adjust the first set pressure at which the first PPRV 142 opens, and to the second PPRV 146 to adjust the second set pressure at which the second PPRV 147 opens. The controller 128 is also configured to send one or more signals to the first lockout valve 144 and to the second lockout valve 148 to open and close the respective valve 144, 148.

Figure 4:
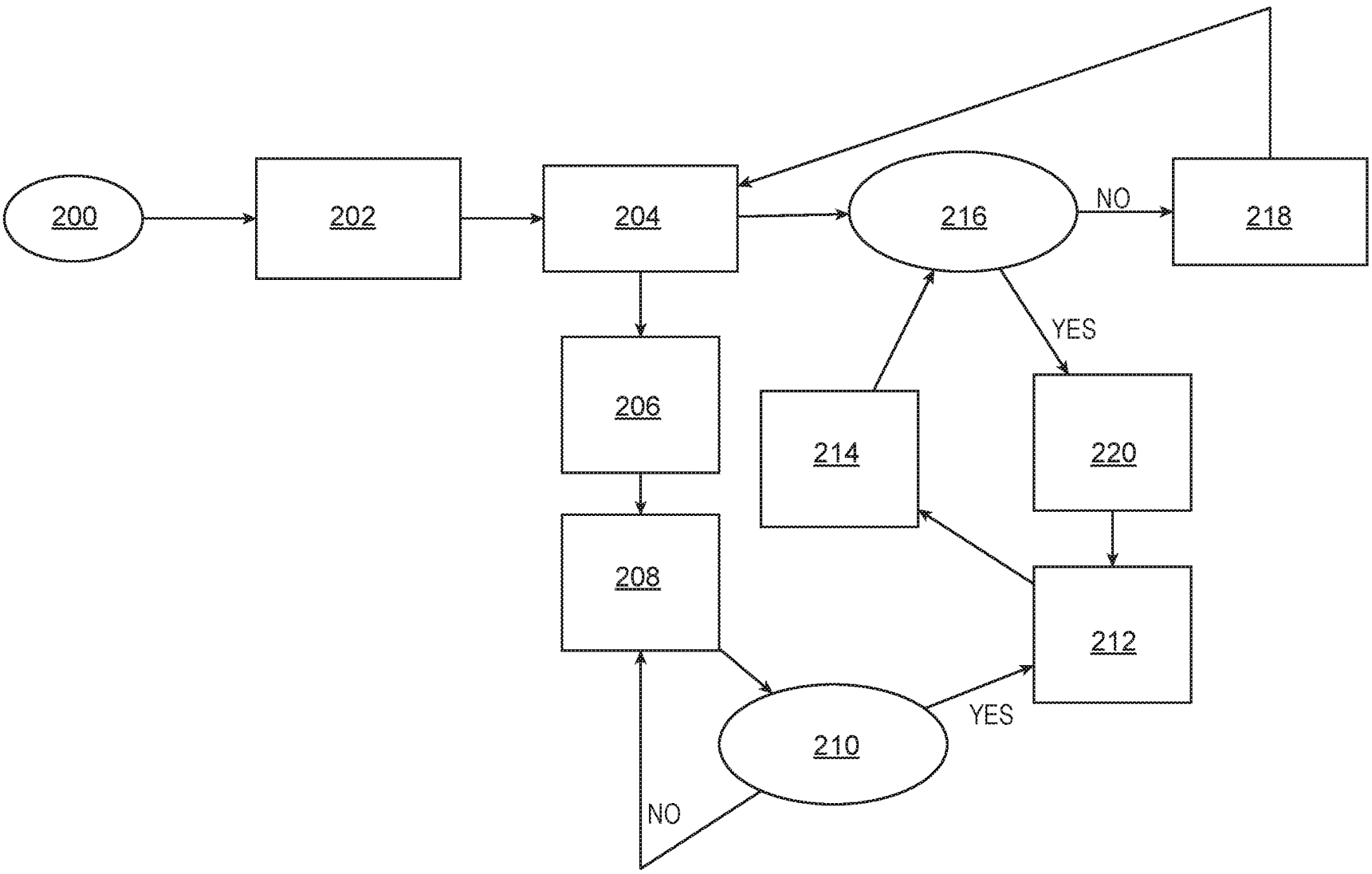
FIG. 4 is a flow diagram showing one possible mode of operation of the variable blade impact system.

FIG. 4 illustrates one possible mode of operating in response to the blade 58 impacting one or more obstacles. This method could also be utilized in embodiments without the blade 58, but with one or more implements that may need to move rapidly in response to an impact of some sort. At step 200, the user activates the blade impact mode on the work vehicle 10. This mode opens the pressure supply valve 140 to fluidly connect the variable flow impact valve 138 to the reservoir 130, the pump 132 and the actuator 136. At step 202, the user sets a desired down force at which a position of the actuator 136 changes upon impact. The controller 128 sends signals to the valves 142, 144, 146 and 148 to maintain the desired down force set by the user. At step 204, the user sets a set blade position using the control valve 134. Operation moves from step 204 to either step 206 or to step 216. At step 206, the position sensor 154 senses a set actuator position while the blade 58 in at the set blade position and communicates the set actuator position to the controller 128. At step 208, the position sensor 154 monitors the position of the actuator 136 and communicates the sensed position to the controller 128. At step 210, the controller 128 compares the sensed position of the actuator 136 to the set position of the actuator 136. If the sensed position of the actuator 136 is different than the set actuator position, operation moves to step 212. If the sensed position of the actuator 136 is identical to the set actuator position, operation returns to step 208.

At step 212, the controller 128 changes the current signal sent to the first PPRV 142 to increase a pressure at the first end 136*a* of the actuator 136. The change in the current signal is based upon a magnitude between the sensed position and the set actuator position, such that the change in current signal is greater for greater magnitudes of change between the sensed position and the set actuator position. At step 214, the first PPRV 142 supplies fluid to the first end 136*a* of the actuator 136 to move the actuator 136 back to the set actuator position.

Operation moves from both step 204 and 214 to step 216. At step 216, the controller 128 determines if the blade 58 has moved from the set blade position in response to impacting an obstacle. If the blade 58 has not moved from the set blade position, operation moves to step 218 at which the blade 58 is maintained at the set position and operation returns to step 204. If the blade 58 has moved from the set blade position, operation moves to step 220. At step 220, the first PPRV 142 permits fluid to flow from the first end 136*a* of the actuator 136 to the reservoir 130 to thereby permit the blade 58 to lift and move over the obstacle. The second end 136*b* of the actuator 136 may include a void or cavity in response to the movement of the actuator 136. Operation then moves to step 212 and to step 214 before returning to step 216.

Figure 5:
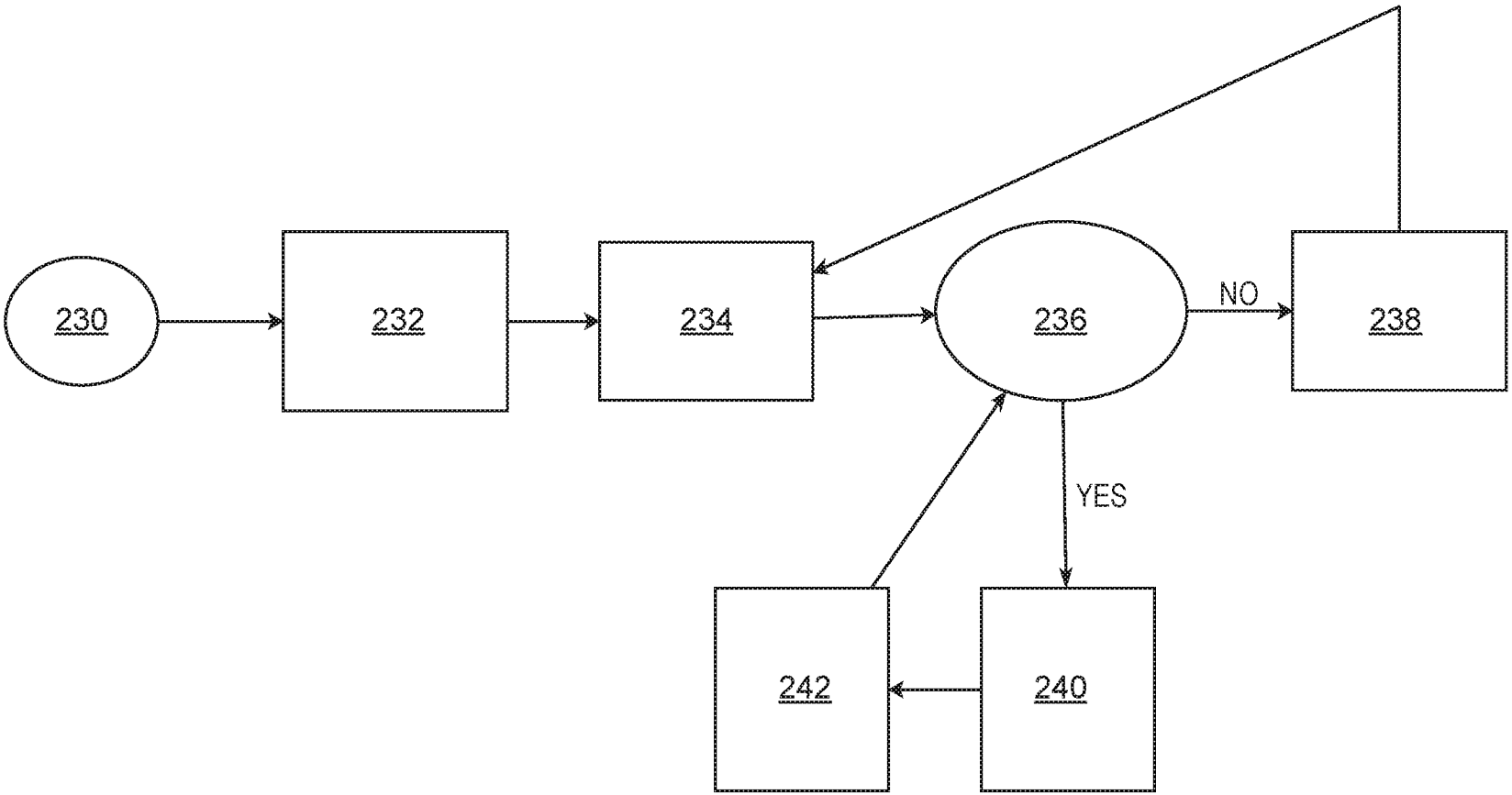
FIG. 5 is a flow diagram showing one possible mode of operation of the variable blade impact system.

FIG. 5 illustrates another possible mode of operating in response to the blade 58 impacting one or more obstacles. This method could also be utilized in embodiments without the blade 58, but with one or more implements that may need to move rapidly in response to an impact of some sort. At step 230, the user activates the blade impact mode on the work vehicle 10. This mode opens the pressure supply valve 140 to fluidly connect the variable flow impact valve 138 to the reservoir 130, the pump 132 and the actuator 136. At step 232, the user sets a desired down force at which a position of the actuator 136 changes upon impact. The controller 128 sends signals to the valves 142, 144, 146 and 148 to maintain the desired down force set by the user. At step 234, the user sets a set blade position using the control valve 134. At step 236, the controller 128 determines if the blade 58 has moved from the set blade position in response to impacting an obstacle. If the blade 58 has not moved from the set blade position, operation moves to step 238 at which the blade 58 is maintained at the set position and operation returns to step 234. If the blade 58 has moved from the set blade position, operation moves to step 240. At step 240, the first PPRV 142 permits fluid to flow from the first end 136*a* of the actuator 136 to the reservoir 130 to thereby permit the blade 58 to lift and move over the obstacle. The second end 136*b* of the actuator 136 may include a void or cavity in response to the movement of the actuator 136. Operation then moves to step 242 at which the first PPRV 142 supplies fluid to the first end 136*a* of the actuator 136 to move the actuator 136 such that the blade 58 returns to the set blade position. Operation then returns to step 236.

Figure 6:
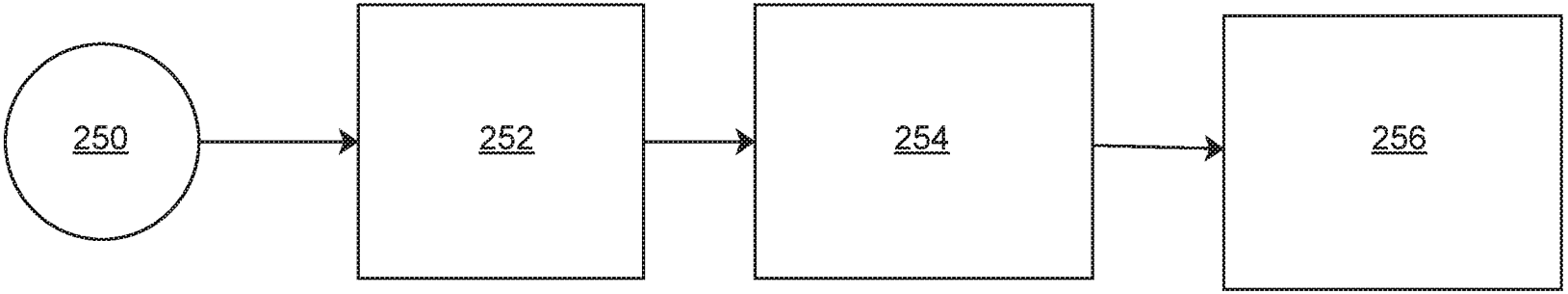
FIG. 6 is a flow diagram showing one possible mode of operation of the variable float flow system.

FIG. 6 illustrates one possible mode of operation in which the blade 58 is permitted to move vertically within a range (i.e., float within a vertical range). At step 250, the operator activates the blade float mode which opens the pressure supply valve 140 to fluidly connect the variable flow impact valve 138 to the reservoir 130, the pump 132 and the actuator 136. At step 252, the user sets a desired down force on the blade 58. The controller 128 sends signals to the valves 142, 144, 146 and 148 to maintain the desired down force set by the user. At step 254, the controller 128 determined the first set pressure at the first end 136*a* and the second set pressure at the second end 136*b* of the actuator. The controller 128 sends the appropriate current signals to the first and second PPRVs 142, 146 to maintain the first and second set pressures at the respective ends 136*a*, 136*b* of the actuator 136. At step 256, the first and second PPRVs 142, 146 relieve and supply fluid to the respective ends 136*a*, 136*b* of the actuator 136 to permit the actuator 136 to float within a range. The down force selected by the user determines the size of the range within which the actuator 136 is permitted to float. For example, if a relatively large down force is selected, the permitted range of movement of the actuator 136 would be relatively small. In contrast, if a relatively small down force is selected, the permitted range of movement of the actuator 136 would be relatively large. If the grader 10 is being utilized to move rocks and dirt, it is likely that a larger down force could be selected. However, if the grader 10 is utilized to move snow and ice, a smaller down force could be selected.

Figure 7:
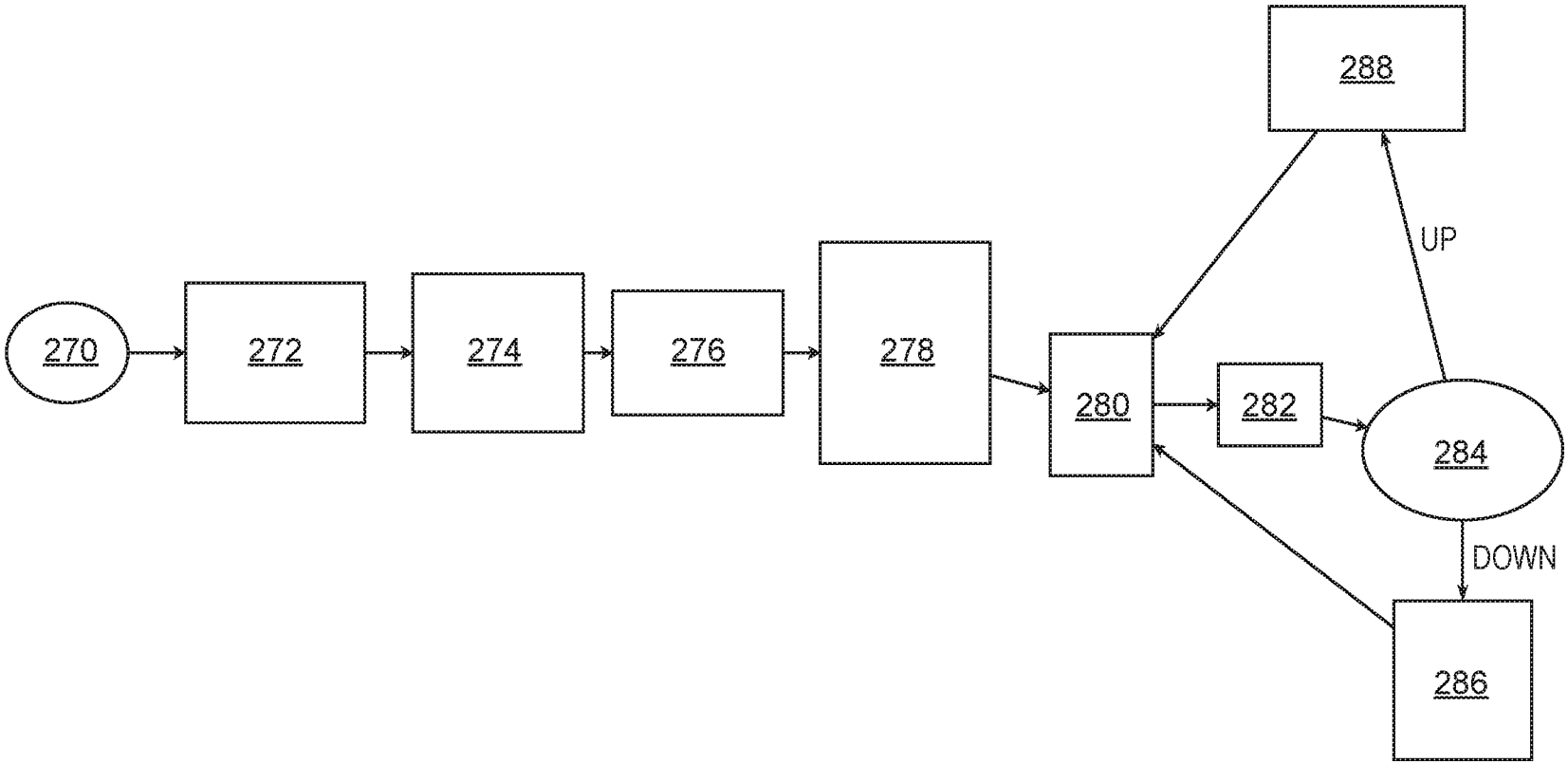
FIG. 7 is a flow diagram showing another possible mode of operation of the variable float flow system.

FIG. 7 illustrates another possible mode of operation in which the blade 58 is permitted to move vertically within a range (i.e., float within a vertical range). At step 270, the operator activates the blade float mode which opens the pressure supply valve 140 to fluidly connect the variable flow impact valve 138 to the reservoir 130, the pump 132 and the actuator 136. At step 272, the user sets a desired down force on the blade 58. The down force is the force at which the actuator moves from its position (i.e., in response to an impact). The controller 128 sends signals to the valves 142, 144, 146 and 148 to maintain the desired down force set by the user. At step 274, the controller 128 sends appropriate signals to the first and second PPRVs 142 and 146 to set a first pressure at which the first PPRV 142 opens and a second pressure at which the second PPRV 146 opens. The first pressure combined with the second pressure determine the down force on the blade 58. At step 276, the first PPRV 142 relieves and supplies fluid to maintain the first PPRV 142 at the first pressure and the second PPRV 146 relieves and supplies fluid to maintain the second PPRV 146 at the second pressure to thereby maintain the desired down force on the blade 58. At step 278, a blade set point is determined. One method for determining the blade set point is for the operator to move the blade 58 to the desired height and indicate that the present position of the blade 58 is the set position via the user interface. Another method for determining the blade set point is for the controller 128 to monitor the blade position after the blade float mode is activated at step 270 and the blade position stabilizes. An additional method for determining the blade set point is for the controller to monitor the blade position over a time period and calculate an average blade position.

At step 280, the blade 58 moves up and down in response to a contour of the ground surface as permitted by the down force. At step 282, the blade position is monitored by the controller 128. At step 284, the controller 128 compares the sensed blade position to the set blade position. If the sensed blade position is below the set blade position (i.e., if the blade moves down), operation moves to step 286. At step 286, the signals sent to the first and second PPRVs 142 and 146 are changed to decrease the down force and to decrease a rate of movement of the blade 58 further in the downward direction. If the sensed blade position is above the set blade position (i.e., if the blade moves up), operation moves to step 288. At step 288, the signals sent to the first and second PPRVs 142 and 146 are changed to increase the down force and to decrease a rate of movement of the blade 58 further in the upward direction.

What is claimed is:

1. A work vehicle comprising:

a frame;

a prime mover connected to the frame;

an operator cab connected to the frame;

a work implement moveable with respect to the frame; and a control circuit operable to control movement of the work implement, the control circuit including a pump, an actuator in fluid communication with the pump, the actuator including a first side and a second side, a control valve fluidly positioned between the pump and the actuator, a controller in electrical communication with the control valve, a reservoir in fluid communication with the actuator, a first proportional pressure relief valve fluidly positioned between the reservoir and the first side of the actuator, the first proportional pressure relief valve configured to permit flow of fluid from the first side of actuator to the reservoir in response to a pressure at the first side of the actuator being greater than a predetermined pressure value, a second proportional pressure relief valve fluidly positioned between the reservoir and the second side of the actuator, and a valve fluidly positioned between the pump and the first proportional pressure relief valve and fluidly positioned between the pump and the second proportional pressure relief valve, such that while the valve is open fluid is permitted to flow from the pump to the first proportional pressure relief valve and to the second proportional pressure relief valve, and while the valve is closed fluid is inhibited from flowing from the pump to the first proportional pressure relief valve and to the second proportional pressure relief valve.

2. The work vehicle of claim 1, the control circuit further comprising a position sensor configured to sense a set position of the actuator set by the user and to communicate the set position to the controller.

3. The work vehicle of claim 2, wherein the controller is configured to receive a signal from the position sensor, to determine if the sensed position is different than the set position, and if the sensed position is different than the set position, the controller is configured to send a signal to the first proportional relief valve to increase the predetermined pressure value to thereby permit fluid flow from the first side of the actuator to the reservoir.

4. The work vehicle of claim 1, wherein the operator cab includes a user interface configured to permit a user to adjust the predetermined pressure value while the user is positioned in the operator cab.

5. The work vehicle of claim 1, wherein the predetermined pressure value is a first predetermined pressure value, wherein the second proportional pressure relief valve is configured to permit flow of fluid from the second side of the actuator to the reservoir while a pressure at the second side of the actuator exceeds a second predetermined pressure value.

6. The work vehicle of claim 5, wherein the first predetermined pressure value is adjustable independently of the second predetermined pressure value.

7. The work vehicle of claim 5, further comprising a first pressure sensor configured to sense the pressure at the first side of the actuator, the first pressure sensor configured to communicate the pressure sensed at the first side of the actuator to the controller, and a second pressure sensor configured to sense the pressure at the second side of the actuator, the second pressure sensor configured to communicate the pressure sensed at the second side of the actuator to the controller.

8. A control system operable to control movement of a work implement of a work vehicle, the control system comprising:

a reservoir configured to retain fluid;

a pump in fluid communication with the reservoir;

an actuator in fluid communication with the pump, the actuator having a first side and a second side;

a control valve fluidly positioned between the pump and the actuator;

a first proportional relief valve fluidly positioned between the pump and the first side of the actuator;

a second proportional relief valve fluidly positioned between the pump and the second side of the actuator; and a position sensor configured to sense a position of a piston in the actuator, and to compare the sensed position to a set position, wherein the first proportional relief valve is configured to permit flow of fluid from the first side of the actuator to the reservoir when a pressure at the first side of the actuator exceeds a pressure set point, wherein the set position is configured to be set by the operator from the cab of the work vehicle, and wherein the controller is configured to send a signal to the first proportional relief valve to increase the pressure set point, to thereby permit flow of fluid from the first side of the actuator to the reservoir when the controller determines that the sensed position differs from the set position.

9. The control system of claim 8, wherein the pressure set point is a first pressure set point, wherein the second proportional relief valve is configured to permit flow of fluid from the second side of the actuator to the reservoir when a pressure at the second side of the actuator exceeds a second pressure set point, and wherein the first pressure set point and the second pressure set point are configured to be adjusted by a user from the cab of the work vehicle.

10. The control system of claim 9, wherein the first pressure set point is configured to be adjusted independently of the second pressure set point.

11. The control system of claim 8, wherein the first proportional relief valve is fluidly connected to the first side of the actuator in parallel with the control valve, and wherein the second proportional relief valve is fluidly connected to the second side of the actuator in parallel with the control valve.

12. The control system of claim 8, further comprising a first pressure sensor configured to sense a first pressure at the first end of the actuator and communicate the first pressure to the controller, and a second pressure sensor configured to sense a second pressure at the second end of the actuator and communicate the second pressure to the controller, wherein the controller is configured to compare the first pressure to the first set point pressure set by the user and to compare the second pressure to the second set point pressure set by the user.

13. The control system of claim 12, wherein the controller is configured to permit flow of fluid from the first side of the actuator to the reservoir while the first pressure is greater than the first pressure set point, and wherein the controller is configured to permit flow of fluid to the first side of the actuator from the pump while the first pressure is less than the second pressure set point.

14. A method of moving a work implement of a work vehicle in response to an impact force, the method comprising:

setting a first set point pressure at which a first proportional relief valve is configured to open via an operator positioned in the work vehicle;

setting a second set point pressure at which a second proportional relief valve is configured to open via the operator positioned in the work vehicle;

monitoring an actuator to detect movement thereof from a first position;

permitting fluid flow between a first side of the actuator, a reservoir and a pump while the first proportional relief valve is open;

permitting fluid flow between a second side of the actuator, the reservoir and the pump while the second proportional relief valve is open;

upon movement of the actuator from the first position, determining if an operator commanded the actuator to move;

if an operator commanded the actuator to move, detecting a second position of the actuator;

if an operator did not command the actuator to move, permitting fluid flow to the first side of the actuator from the pump to thereby inhibit movement of the actuator away from the first position;

monitoring a first side working pressure at the first side of the actuator;

comparing the first side working pressure to the first set point pressure; and while the first side working pressure is less than the first set point pressure, opening the first proportional pressure relief valve to permit fluid to flow from the reservoir into the first side of the actuator.

15. The method of claim 14, further comprising monitoring a second side working pressure at the second side of the actuator, comparing the second side working pressure to the second set point pressure, and while the second side working pressure is greater than the second set point pressure, opening the second proportional relief valve to permit fluid to flow from the second side of the actuator to the reservoir.

16. The method of claim 14, wherein monitoring the actuator to detect movement thereof from the first position includes monitoring the actuator with a position sensor.

17. The method of claim 14, further comprising adjusting the first set point pressure via an operator positioned in the work vehicle, and adjusting the second set point pressure via the operator positioned in the work vehicle.

18. A method of moving a work implement of a work vehicle, the method comprising:

setting a downward force on the work implement;

determining a set position of the work implement;

permitting fluid flow between a first side of an actuator, a reservoir and a pump while a first valve is open;

permitting fluid flow between a second side of the actuator, the reservoir and the pump while a second valve is open;

upon movement of the work implement from the set position, determining if the work implement moved upward or downward from the set position;

if the work implement moved upward from the set position, the controller configured to send a first signal to the first valve and to the second valve to increase the downward force on the work implement to thereby inhibit further upward movement of the work implement; and if the work implement moved downward from the set position, the controller configured to send a second signal to the first valve and to the second valve to decrease the downward force on the work implement to inhibit further downward movement of the work implement.

19. The method of claim 18, wherein determining the set position of the work implement includes determining a position of the work implement set by the user, wherein the first valve is a first proportional relieving/reducing valve and the second valve is a second proportional relieving/reducing valve.

20. The method of claim 18, wherein determining the set position of the work implement includes sensing a position of the work implement after setting the downward force.

21. The method of claim 18, wherein determining the set position of the work implement includes calculating an average position of the work implement during a set time period.

22. The method of claim 18, wherein setting the down force includes setting a first set point pressure at which the first proportional relief valve is configured to open via an operator positioned in the work vehicle, and setting a second set point pressure at which the second proportional relief valve is configured to open via the operator positioned in the work vehicle.

* * * * *